US010982348B2

(12) United States Patent
Shamoto et al.

(10) Patent No.: US 10,982,348 B2
(45) Date of Patent: Apr. 20, 2021

(54) PLATING APPARATUS

(71) Applicant: EBARA CORPORATION, Tokyo (JP)

(72) Inventors: Mitsuhiro Shamoto, Tokyo (JP); Masashi Shimoyama, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 72 days.

(21) Appl. No.: 16/393,381

(22) Filed: Apr. 24, 2019

(65) Prior Publication Data

US 2019/0338438 A1 Nov. 7, 2019

(30) Foreign Application Priority Data

May 7, 2018 (JP) ..... JP2018-089347

(51) Int. Cl.

| | |
|---|---|
| ***C25D 17/12*** | (2006.01) |
| ***C25D 17/06*** | (2006.01) |
| ***C25D 17/02*** | (2006.01) |
| ***C25D 17/00*** | (2006.01) |

(52) U.S. Cl.

CPC ..... *C25D 17/12* (2013.01); *C25D 17/001* (2013.01); *C25D 17/005* (2013.01); *C25D 17/02* (2013.01); *C25D 17/06* (2013.01)

(58) Field of Classification Search

CPC ..... C25D 17/12

See application file for complete search history.

(56) References Cited

U.S. PATENT DOCUMENTS

| | | | | |
|---|---|---|---|---|
| 3,855,083 | A * | 12/1974 | Hoeckelman | C25D 7/0642 205/97 |
| 5,421,987 | A * | 6/1995 | Tzanavaras | C25D 5/026 204/212 |
| 5,985,123 | A * | 11/1999 | Koon | C25D 5/08 204/198 |
| 6,755,946 | B1 * | 6/2004 | Patton | C25D 17/06 204/224 R |
| 7,556,722 | B2 * | 7/2009 | Metzger | C25D 5/20 204/233 |
| 7,682,498 | B1 * | 3/2010 | Mayer | C25D 17/001 205/640 |
| 2006/0163055 | A1 * | 7/2006 | Vereecken | H01L 21/2885 204/228.9 |
| 2006/0283709 | A1 * | 12/2006 | Andricacos | C25D 17/12 205/96 |

(Continued)

FOREIGN PATENT DOCUMENTS

| | | | |
|---|---|---|---|
| JP | 2017-115171 | A | 6/2017 |
| WO | WO 02/053806 | A2 * | 7/2002 |

*Primary Examiner* — Harry D Wilkins, III

(74) *Attorney, Agent, or Firm* — Rothwell, Figg, Ernst & Manbeck, P.C.

(57) ABSTRACT

A plating apparatus that reduces a terminal effect is provided. The plating apparatus is provided. The plating apparatus includes a substrate holder for holding a substrate as a plating object, an electric contact disposed on the substrate holder to apply a current to a substrate, and a plurality of anodes arranged to face the substrate holder. Each of the plurality of anodes has a long and thin shape. Each of the plurality of anodes is arranged such that a longitudinal direction of the anode is parallel to a surface of a substrate held onto the substrate holder and such that at least one end in the longitudinal direction of each of the anodes faces the electric contact of the substrate holder.

8 Claims, 7 Drawing Sheets

(56) References Cited

U.S. PATENT DOCUMENTS

| | | | | |
|---|---|---|---|---|
| 2007/0068819 | A1* | 3/2007 | Singh | H01L 21/2885 205/83 |
| 2013/0299343 | A1* | 11/2013 | Harris | C25D 7/123 204/263 |
| 2015/0275390 | A1* | 10/2015 | Tsujino | C25D 17/001 204/242 |
| 2016/0230285 | A1* | 8/2016 | Yamamoto | C23C 18/163 |
| 2017/0058423 | A1* | 3/2017 | Mine | H01L 21/68785 |
| 2017/0298529 | A1* | 10/2017 | Cheng | C25D 17/007 |
| 2019/0390360 | A1* | 12/2019 | Shimomura | C25D 5/022 |

* cited by examiner

PLATING APPARATUS

CROSS-REFERENCE TO RELATED APPLICATION

This application is based upon and claims the benefit of priority of the prior Japanese Patent Application No. 2018-089347, filed on May 7, 2018, the entire content of which is incorporated herein by reference.

TECHNICAL FIELD

This application relates to a plating apparatus and especially relates to an electroplating apparatus.

BACKGROUND ART

Conventionally, wiring has been formed on fine grooves for wiring, holes, or resist openings provided on surfaces of a substrate such as a semiconductor wafer, and bumps (protruding electrode) electrically connected to electrodes of a package or similar component has been formed on the surface of the substrate. As such method for forming these wiring and bump, a method such as an electroplating method, a deposition method, a printing method, and a ball bump method has been known. In accordance with increase in the number of I/Os of a semiconductor chip and decrease in pitch, the electroplating method that allows miniaturization and provides comparatively stable performance has been often used.

When the electroplating is performed on the substrate such as the semiconductor wafer, an anode sometimes has a shape similar to that of the substrate as a plating object to arrange the anode and the substrate in parallel in an electrolyte. For example, when the substrate as the plating object is circular, the anode may be configured circular having a similar size. When the substrate as the plating object is quadrangular, a quadrangular anode having a similar size may be used as the anode.

When the wiring or the bump is formed in the electroplating method, a seed layer (power feed layer) having a low electrical resistance is formed on a surface of a barrier metal provided on the grooves for wiring, the holes, or the resist openings on the substrate. A plating film grows on a surface of this seed layer. Recently, in accordance with the miniaturization of the wiring and the bump, the seed layer having a thinner film thickness has been used. As the film thickness of the seed layer thins, an electrical resistance (sheet resistance) of the seed layer increases.

Generally, the substrate to be plated has an electric contact on its peripheral edge portion. In view of this, a current corresponding to a combined resistance of an electric resistance value of a plating solution and an electric resistance value of the seed layer from a center portion of the substrate to the electric contact flows through the center portion of the substrate. Meanwhile, a current approximately corresponding to the electric resistance value of the plating solution flows through the peripheral edge portion (near the electric contact) of the substrate. That is, the current is less likely to flow through the center portion of the substrate by the electric resistance value of the seed layer from the center portion of the substrate to the electric contact. This phenomenon that the current concentrates on the peripheral edge portion of the substrate is referred to as a terminal effect.

The thinner the film thickness of the seed layer of the substrate is, the larger the electric resistance value of the seed layer from the center portion of the substrate to the electric contact is. In view of this, the thinner the film thickness of the seed layer of the substrate is, the more significant the terminal effect in the plating is. As a result, a plating rate in the center portion of the substrate decreases, the film thickness of the plating film in the center portion of the substrate becomes thinner than that of the plating film in the peripheral edge portion of the substrate, and an in-plane uniformity of the film thickness decreases.

To suppress the decrease in the in-plane uniformity of the film thickness due to the terminal effect, it is necessary to adjust an electric field applied to the substrate. For example, a plating apparatus that installs a regulating plate, which adjusts an electric potential distribution between an anode and a substrate, between the anode and the substrate has been known (see PTL 1).

CITATION LIST

Patent Literature

PTL 1: Japanese Unexamined Patent Application Publication No. 2017-115171

SUMMARY OF INVENTION

As described above, when the regulating plate is arranged between the anode and the substrate to reduce the terminal effect, a space to arrange the regulating plate is needed between the anode and the substrate. Generally, the larger a distance between the anode and the substrate is, the smaller an influence of the terminal effect is. Therefore, when the electroplating is performed by arranging a tabular anode having a size similar to that of the substrate as the plating object parallel to the substrate, considering the reduction of the terminal effect, there is a constant limitation to decrease the distance between the anode and the substrate. The larger the distance between the substrate and the anode is, the larger a volume of a plating tank on which they are arranged is and the larger a size of the plating apparatus is. The larger the plating tank is, the larger a necessary amount of the plating solution is and the larger a running cost of the plating apparatus is.

One object of this application is to provide a plating apparatus that reduces a terminal effect. One object of this application is to reduce the terminal effect while decreasing a distance between a substrate and an anode.

According to one embodiment, a plating apparatus is provided. The plating apparatus includes a substrate holder that holds a substrate as a plating object, an electric contact disposed on the substrate holder to apply a current to a substrate, and a plurality of anodes arranged to face the substrate holder. Each of the plurality of anodes has a long and thin shape. Each of the plurality of anodes is arranged such that a longitudinal direction of the anode is parallel to a surface of the substrate held onto the substrate holder and such that at least one end in the longitudinal direction of each of the anodes faces the electric contact of the substrate holder.

DETAILED DESCRIPTION

Figure 1:
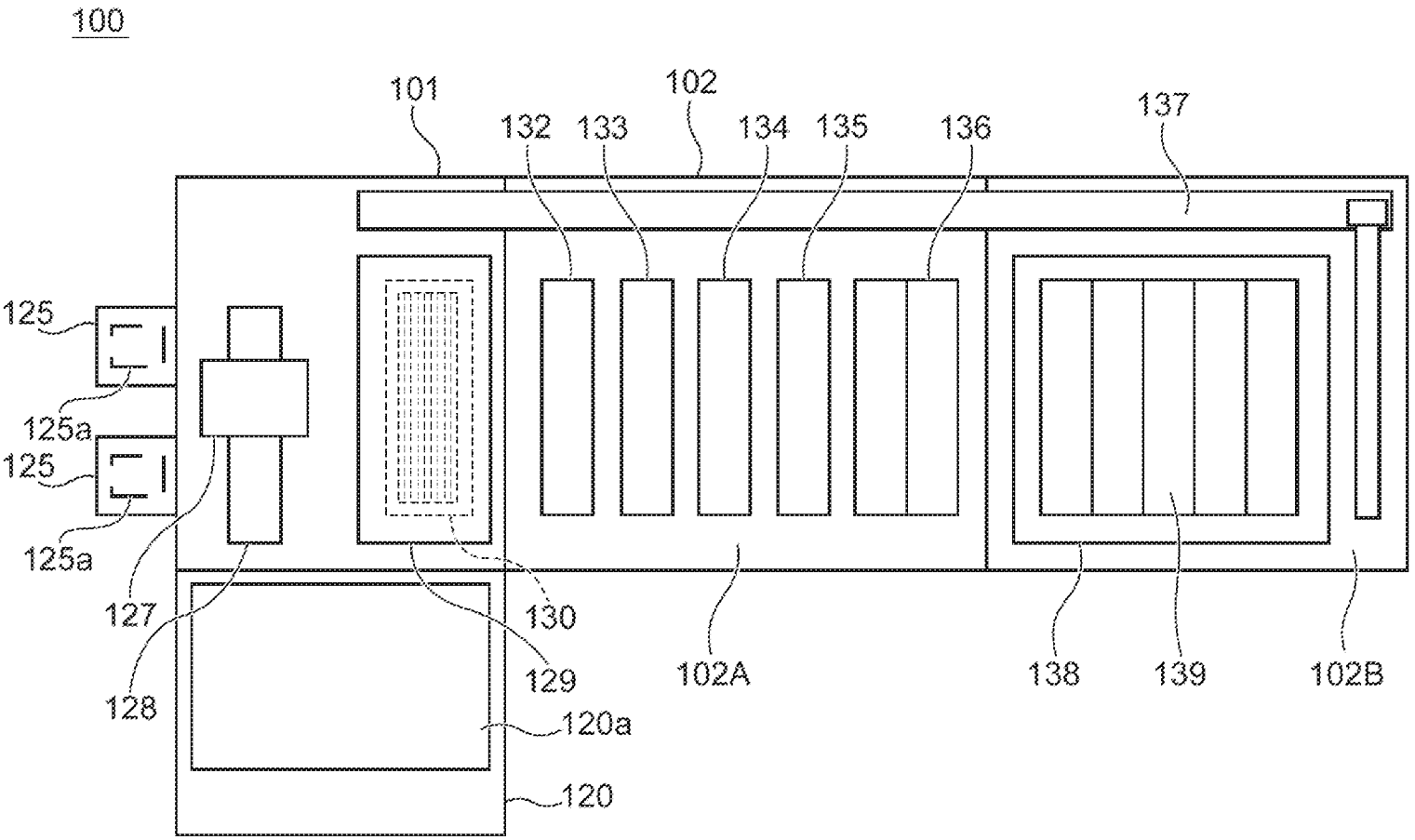
FIG. 1 is a top view schematically illustrating an overall arrangement of a plating apparatus according to one embodiment.

The following describes embodiments of a plating apparatus according to the present invention with the attached drawings. In the attached drawings, identical or similar reference numerals are attached to identical or similar components, and overlapping description regarding the identical or similar components may be omitted in the description of the respective embodiments. Features shown in the respective embodiments are applicable to other embodiments in so far as they are consistent with one another.

FIG. 1 is a top view schematically illustrating an overall arrangement of a plating apparatus 100 according to one embodiment. The plating apparatus 100 may be configured as one for performing a plating process on a polygonal substrate or may be configured as one for performing the plating process on a circular substrate as described below. As illustrated in FIG. 1, this plating apparatus 100 is roughly divided into a loading/unloading unit 101, which loads a substrate to a substrate holder or unloads the substrate from the substrate holder, a processing unit 102, which processes the substrate, and a cleaning unit 120. The processing unit 102 further includes a preprocessing/postprocessing unit 102A, which performs preprocessing and postprocessing on the substrate, and a plating processing unit 102B, which performs a plating process on the substrate. The loading/unloading unit 101, the processing unit 102, and the cleaning unit 120 of the plating apparatus 100 are surrounded by respective different frames (housings).

The loading/unloading unit 101 includes two cassette tables 125 and a substrate removal/mounting mechanism 129. The cassette table 125 includes a cassette 125*a* that houses a substrate. The substrate removal/mounting mechanism 129 is configured to mount/remove the substrate on/from the substrate holder (not illustrated). A stocker 130 to house the substrate holder is disposed at the proximity of (for example, under) the substrate removal/mounting mechanism 129. In the center of these units 125, 129, and 130, a substrate conveying device 127 formed of a robot for conveyance that conveys the substrate between these units is arranged. The substrate conveying device 127 is configured to run with a running mechanism 128.

The cleaning unit 120 includes a cleaning device 120*a* that cleans and dries the substrate after the plating process. The substrate conveying device 127 is configured to convey the substrate after the plating process to the cleaning device 120*a* and take out the cleaned and dried substrate from the cleaning device 120*a*.

The preprocessing/postprocessing unit 102A includes a pre-wet tank 132, a pre-soak tank 133, a pre-rinse tank 134, a blow tank 135, and a rinse tank 136. In the pre-wet tank 132, the substrate is immersed in a pure water. In the pre-soak tank 133, an oxide film on a surface of a conducting layer such as a seed layer formed on a surface of the substrate is removed by etching. In the pre-rinse tank 134, the substrate after pre-soak is cleaned with a cleaning liquid (for example, pure water) together with the substrate holder. In the blow tank 135, liquid draining of the substrate after cleaning is performed. In the rinse tank 136, the substrate after plating is cleaned with the cleaning liquid together with the substrate holder. The pre-wet tank 132, the pre-soak tank 133, the pre-rinse tank 134, the blow tank 135, and the rinse tank 136 are arranged in this order.

The plating processing unit 102B includes a plurality of plating tanks 139 including an overflow tank 138. Each plating tank 139 internally houses one substrate and immerses the substrate in a plating solution internally held to perform plating such as copper plating on the surface of the substrate. Here, a type of the plating solution is not especially limited, and various plating solutions are used as usage.

The plating apparatus 100 includes a substrate holder conveyance device 137 positioned lateral to these respective devices. The substrate holder conveyance device 137 employs, for example, a linear motor system to convey the substrate holder between these respective devices together with the substrate. This substrate holder conveyance device 137 is configured to convey the substrate holder between the substrate removal/mounting mechanism 129, the pre-wet tank 132, the pre-soak tank 133, the pre-rinse tank 134, the blow tank 135, the rinse tank 136, and the plating tank 139.

Figure 2:
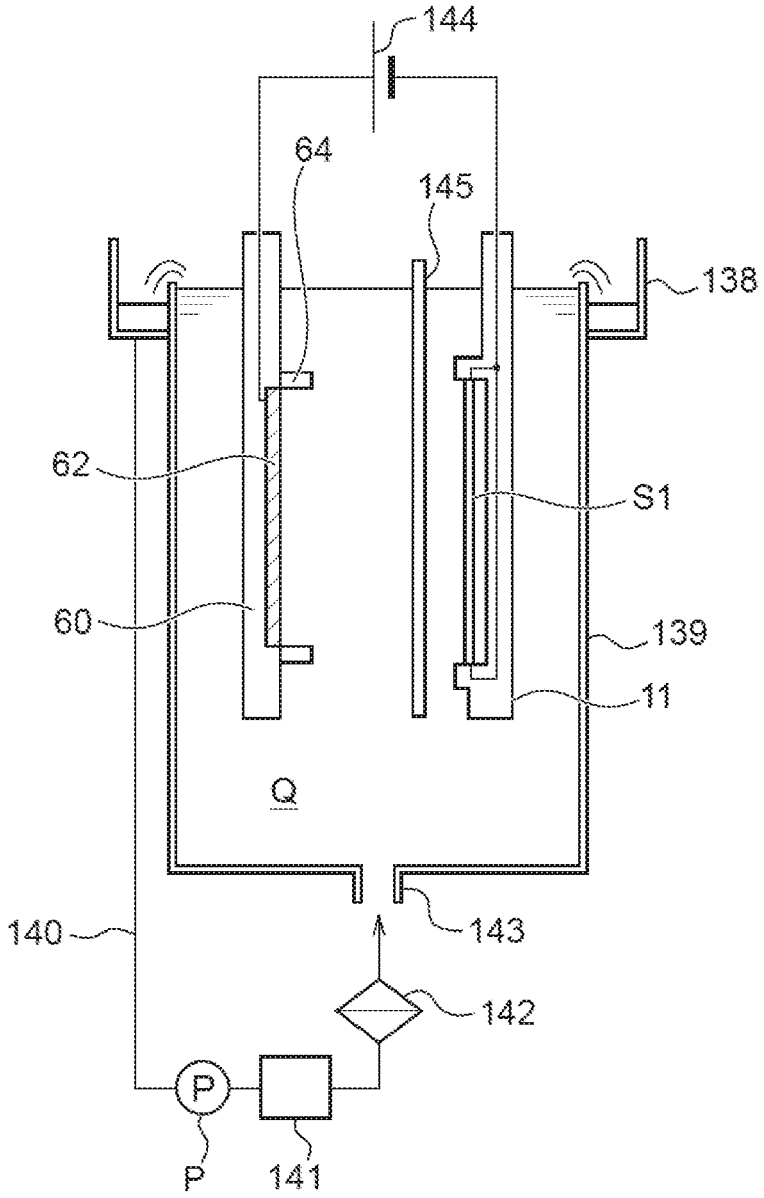
FIG. 2 is a schematic longitudinal sectional front view illustrating a plating tank and an overflow tank of a plating processing unit illustrated in FIG. 1.

FIG. 2 is a schematic longitudinal sectional front view illustrating the plating tank 139 and the overflow tank 138 of the plating processing unit 102B illustrated in FIG. 1. As illustrated in FIG. 2, the plating tank 139 internally holds a plating solution Q. The overflow tank 138 is disposed on an outer periphery of the plating tank 139 to receive the plating solution Q that has overflowed from an edge of the plating tank 139. The overflow tank 138 has a bottom portion connected to one end of a plating solution supply passage 140 including a pump P. The plating solution supply passage 140 has another end connected to a plating solution inlet 143 disposed on a bottom portion of the plating tank 139. This returns the plating solution Q accumulated in the overflow tank 138 into the plating tank 139 in association with driving of the pump P. The plating solution supply passage 140 includes a thermostat 141, which adjusts a temperature of the plating solution Q, and a filter 142, which removes a foreign object in the plating solution, on a downstream side of the pump P.

The plating tank 139 houses a substrate holder 11 holding a substrate S1. The substrate holder 11 is arranged in the plating tank 139 such that the substrate S1 is immersed in the plating solution Q in a vertical state. An anode 62 held onto an anode holder 60 is arranged on a position facing the substrate S1 in the plating tank 139. Detailed structure and arrangement of the anode 62 according to the embodiment will be described later, but a plurality of anodes 62 having elongate shapes are arranged on the anode holder 60. A regulation plate 64 projecting in a direction to the substrate S1 is mounted on a front surface side (a side facing the substrate S1) of the anode holder 60. The regulation plate 64 is disposed to surround a whole peripheral area of the plurality of anodes 62. The regulation plate 64 is formed of a dielectric material. The regulation plate 64 adjusts a direction of the electric field between the anode 62 and the substrate S1. The regulation plate 64 may be fixed to the anode holder 60 or may be configured simply attachable to and removable from the anode holder 60 with a mounting member such as a screw. The substrate S1 is electrically connected to the anode 62 via a plating power supply 144. Applying the current between the substrate S1 and the anode 62 forms a plating film (for example, a copper film) on a surface of the substrate S1.

A paddle 145, which is reciprocated parallel to the surface of the substrate S1 to stir the plating solution Q, is arranged between the substrate S1 and the anode 62. The paddle 145 stirs the plating solution Q to allow sufficient copper ions to be uniformly supplied to the surface of the substrate S1.

Figure 3:
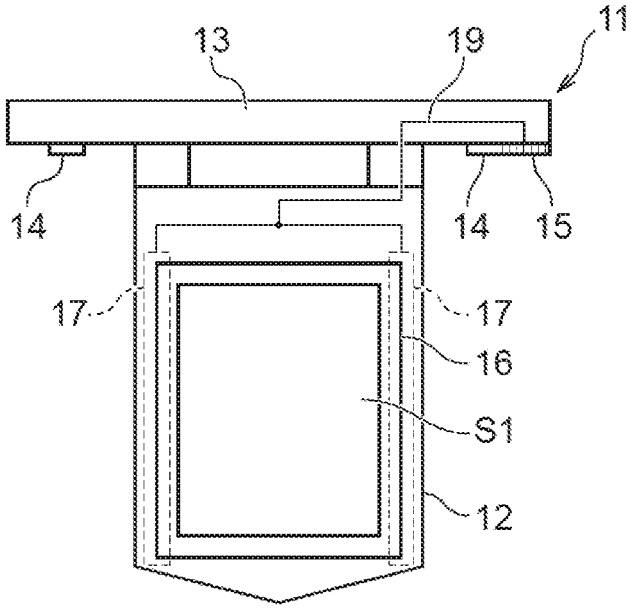
FIG. 3 is a schematic plan view of a substrate holder according to one embodiment.

FIG. 3 is a schematic plan view of the substrate holder 11. The substrate holder 11 in FIG. 3 is configured to hold a polygonal substrate. As illustrated in FIG. 3, the substrate holder 11 includes a tabular substrate holder main body 12 made of, for example, vinyl chloride and an arm portion 13 connected to the substrate holder main body 12. The arm portion 13 includes a pair of pedestals 14. Installation of the pedestals 14 on top surfaces of peripheral walls of the respective processing tanks illustrated in FIG. 1 causes the substrate holder 11 to be perpendicularly suspended and supported. A connector portion 15 is disposed on the arm portion 13. The connector portion 15 is configured to contact an electric contact disposed on the plating tank 139 when the pedestals 14 are installed on the top surfaces of the peripheral wall of the plating tank 139. This causes the substrate holder 11 to be electrically connected to the plating power supply 144 illustrated in FIG. 2 to apply a voltage and a current to the substrate S1 held onto the substrate holder 11.

The substrate holder 11 holds the polygonal substrate S1 such that a surface to be plated of the polygonal substrate S1 illustrated in FIG. 3 is exposed. In other words, the substrate holder 11 has an edge portion 16 forming a polygonal opening to expose the held polygonal substrate S1. The substrate holder 11 includes electric contacts 17 (indicated by dashed lines in FIG. 3) that contact the surface of the polygonal substrate S1. In the embodiment in the drawing, when the substrate holder 11 holds the polygonal substrate S1, these electric contacts 17 contact the surface of the polygonal substrate S1 along opposed two sides of the polygonal substrate S1. The polygonal substrate S1 has a shape that is square or rectangular. When the polygonal substrate is rectangular, the electric contacts 17 are configured to contact any opposed two sides of long sides or short sides of the polygonal substrate that is rectangular. In the embodiment in FIG. 3, the electric contacts 17 are configured to contact the long sides of the polygonal substrate S1. The electric contacts 17 of the substrate holder 11 are connected to the connector portion 15 with wiring 19.

Figure 4:
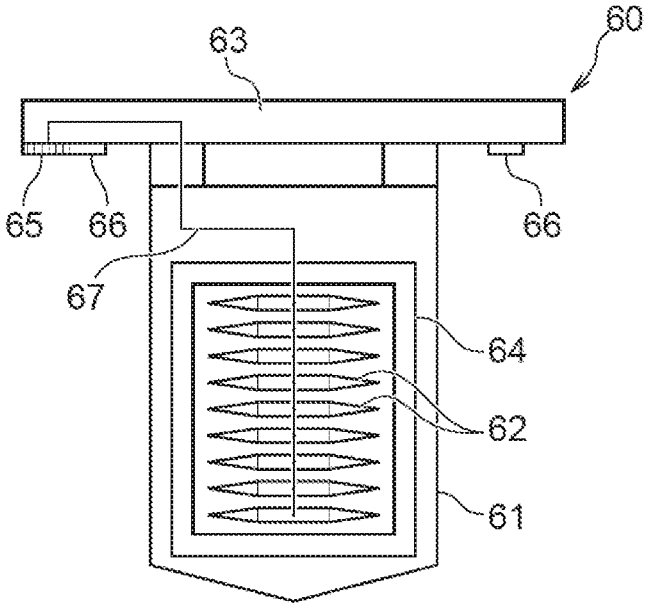
FIG. 4 is a schematic plan view of an anode holder illustrated in FIG. 2.

FIG. 4 is a schematic plan view of the anode holder 60 used with the substrate holder 11 for polygonal substrate illustrated in FIG. 3. As illustrated in FIG. 4, the anode holder 60 includes a tabular anode holder main body 61 and an arm portion 63 connected to the anode holder main body 61. The arm portion 63 includes a pair of pedestals 66. Installation of the pedestals 66 on the top surface of the peripheral wall of the plating tank 139 illustrated in FIG. 1 causes the anode holder 60 to be perpendicularly suspended and supported.

Figure 5:
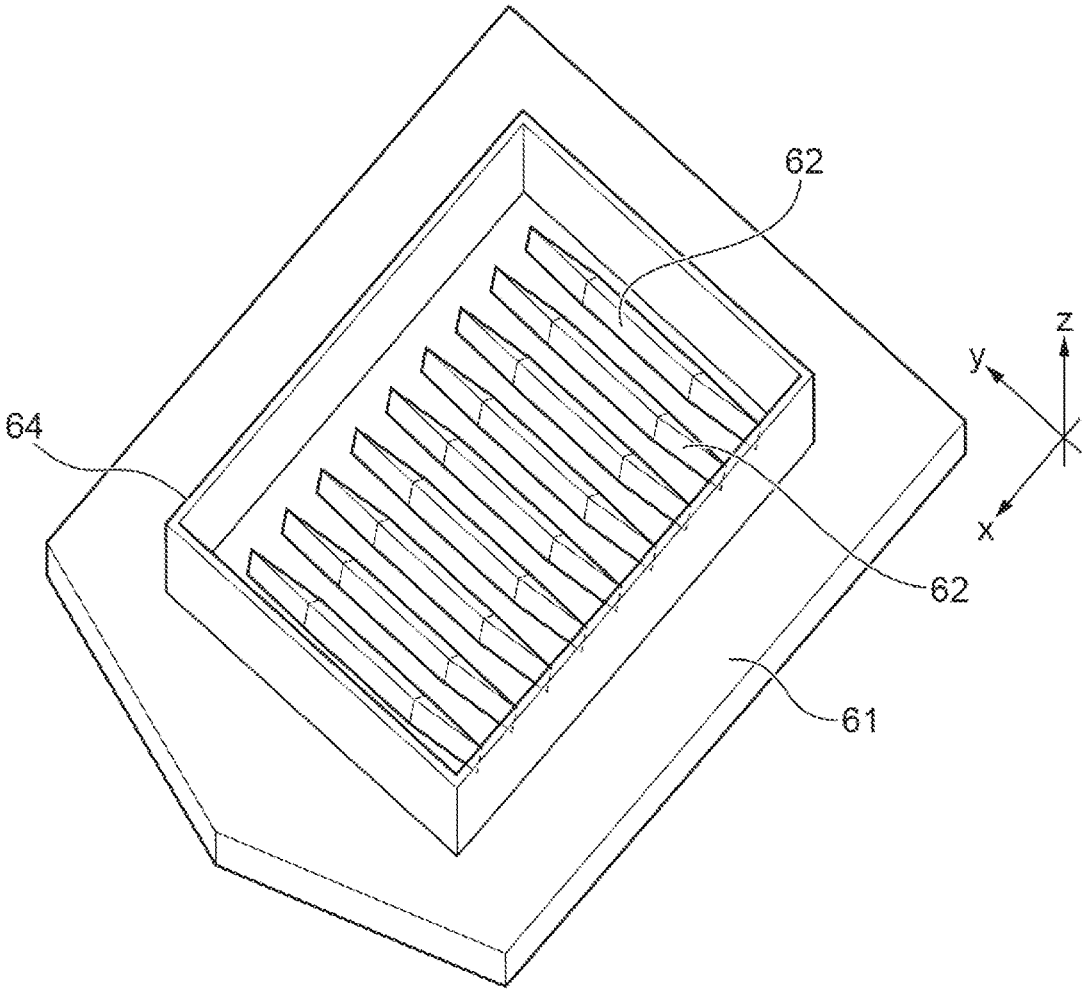
FIG. 5 is a schematic perspective view of the anode holder illustrated in FIG. 4.

FIG. 5 is a schematic perspective view of the anode holder 60 illustrated in FIG. 4. However, FIG. 5 illustrates only the anode holder main body 61, the anodes 62, and the regulation plate 64 of the anode holder 60 for clarity of illustration and omits the arm portion 63 and the like. As illustrated in the drawing, the plurality of elongate anodes 62 are arranged in parallel on the anode holder main body 61. In the embodiment in the drawing, the plurality of anodes 62 are equally spaced. The number of anodes 62 is optional. The number and the arrangement of the anodes 62 may be changed corresponding to, for example, the shape of the polygonal substrate S1 as a plating object. In the anode holder 60 according to the embodiment in the drawing, the regulation plate 64 is disposed to project from a surface of the tabular anode holder main body 61. The regulation plate 64, which is a dielectric (insulating) member having a thin wall shape, is configured to surround whole of the plurality of anodes 62. In other words, the anodes 62 are arranged in a region surrounded by the wall regulation plate 64. The region surrounded by the regulation plate 64 has an area approximately identical to an area of the substrate S1 as the plating object. As illustrated in FIG. 2, the regulation plate 64 is arranged to project from the anode holder main body 61 toward the substrate S1 when the regulation plate 64 is arranged in the plating tank 139 together with the substrate holder 11. In the embodiment in the drawing, the regulation plate 64 has a height in a direction (a z direction in FIG. 5) perpendicular to a planar surface of the anode holder main body 61. This height is set higher than a height H of the anode 62. The regulation plate 64 adjusts the direction of the electric field between the anode 62 and the substrate S1. The regulation plate 64 may be omitted if it is not necessary. In one embodiment, the regulation plate 64 may be a body separately from the anode holder 60 and the substrate holder 11 to be disposed between the anode holder 60 and the substrate holder 11.

Figure 6:
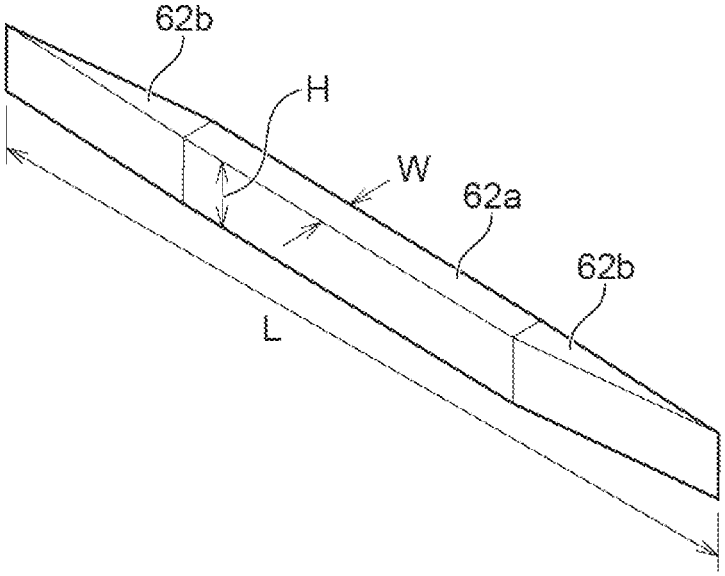
FIG. 6 is a perspective view illustrating an anode according to one embodiment alone.

In the embodiment in the drawing, the plurality of anodes 62 are elongate and arranged on the anode holder main body 61 such that their longitudinal directions are parallel to one another. In a state where the anode holder 60 and the substrate holder 11 are arranged on the plating tank 139, the longitudinal direction of the anode 62 will be parallel to the surface of the substrate S1. FIG. 6 is a perspective view illustrating the anode 62 according to one embodiment alone. As illustrated in the drawing, the anode 62 includes a constant-width portion 62*a* having a constant width W and a tapered portion 62*b* where the width W decreases toward an end. In the embodiment in FIG. 4 to FIG. 6, the tapered portions 62*b* are disposed on both end portions of the constant-width portion 62*a* to be configured such that the anode 62 has both end portions that are tapered. In the embodiment in the drawing, the anode 62 has an approximately rectangular cross-section when the anode 62 is cut out in a planar surface perpendicular to the longitudinal direction. The rectangle includes the square. The rectangular cross-section of the anode 62 has corner portions that may be roundly formed. In another embodiment, the cross-sectional shape need not be rectangular. For example, an anode whose cross-sectional shape is oval or circular may be used. The width W of the anode 62 is a dimension in a direction perpendicular to the longitudinal direction and a height direction. In FIG. 5, the width W of the anode 62 is a dimension in an x direction, the height H is a dimension in the z direction, and a length L is indicated as a dimension of ay direction. In the state where the anode holder 60 and the substrate holder 11 are arranged on the plating tank 139, the ends in the longitudinal direction of the anode 62 are arranged to face the electric contacts 17 of the substrate holder 11. In one embodiment, as illustrated in FIG. 3, the electric contacts 17 are arranged along the long sides of the polygonal substrate S1, and the anode 62 is arranged such that its longitudinal direction is parallel to the short sides of the polygonal substrate S1. In other words, the longitudinal direction of the electric contact 17 of the substrate holder 11 is perpendicular to the longitudinal direction of the anode 62. In the embodiment in the drawing, the length L of the anode 62 is shorter than the short side of the polygonal substrate S1. In one embodiment, the constant-width portion 62*a* and the tapered portion 62*b* of the anode 62 may be formed as an integrated member. In one embodiment, the constant-width portion 62*a* and the tapered portion 62*b* of the anode 62 may be formed as separate components to be combined together later. Forming and combining a plurality of constant-width portions 62*a* having different dimensions and a plurality of tapered portions 62*b* having different dimensions can easily form anodes 62 having various dimensions in total. For example, forming a plurality of constant-width portions 62*a* and tapered portions 62*b* having different lengths allows an anode 62 having a dimension corresponding to a dimension of the polygonal substrate S1 as the plating object to be used.

The anode 62 can be formed of various materials corresponding to a purpose of the plating process. In one embodiment, the anode 62 can be an insoluble anode. In one embodiment, the anode 62 can be formed of an alloy containing titanium and platinum or an alloy containing titanium and iridium oxide. In one embodiment, the anode 62 can be formed as a solid member. In one embodiment, the anode 62 may be formed hollow such that thin metallic plates are stuck one another. The anode 62 may be a soluble anode such as phosphorus-containing copper having a surface on which coating has been performed so as not to change the dimensions in the x direction and they direction.

Figure 7:
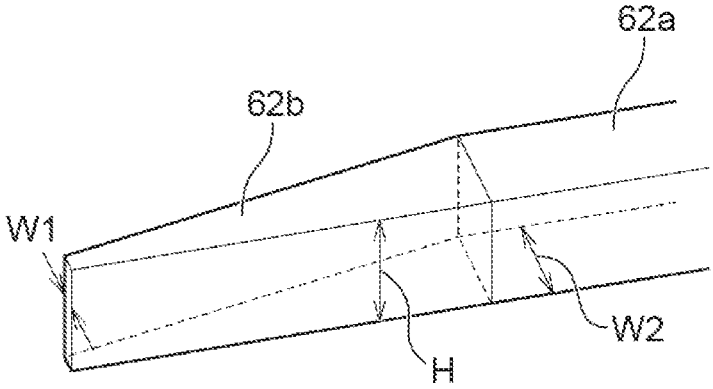
FIG. 7 is an enlarged perspective view of the vicinity of an end of the anode illustrated in FIG. 6.

FIG. 7 is an enlarged perspective view illustrating the vicinity of the end of the anode 62 illustrated in FIG. 6. The dimensions of the anode 62 can be optional. In one embodiment, the respective dimensions of the anode 62 meet a condition of $W1<W2<H$ when the height of the anode 62 is defined as H, a width of the constant-width portion 62*a* is defined as W2, and a width of the end of the tapered portion 62*b* is defined as W1. In one embodiment, the respective dimensions of the anode 62 meet a condition of $2\times W1<W2\leq 10\times W1$ and $10\times W1<H\leq 30\times W1$. In one embodiment, W1 can be 1 mm or more. These conditions are preferred conditions to uniformly plate the substrate and to decrease the distance between the anode and the substrate.

As illustrated in FIG. 4, the arm portion 63 includes a connector portion 65 configured to contact the electric contact disposed on the plating tank 139 when the pedestals 66 are installed on the top surface of the peripheral wall of the plating tank 139. As illustrated in FIG. 4, the connector portion 65 is connected to the respective anodes 62 with wiring 67. This electrically connects the anode holder 60 to the plating power supply 144 illustrated in FIG. 2 to apply the voltage and the current to the anode 62. As illustrated in FIG. 4, the respective anodes 62 are connected to the wiring 67 at centers in the longitudinal direction. In one embodiment, the respective anodes 62 are electrically arranged in parallel to ensure a configuration where identical electric potential is applied to the respective anodes 62 from the identical power supply 144. In one embodiment, it can be configured such that different electric potentials independent of one another are applied to all or a part of the plurality of anodes 62. For example, in the arrangement of the anodes 62 illustrated in FIG. 4, the electric potential applied to two anodes 62 arranged on end portions in an up-down direction may be configured to be controlled independently from the electric potential applied to the other anodes 62. Such arrangement can control the current near the end portions, where the change in the film thickness of the plating is likely to occur, of the substrate S1 independently from the current flowing through a center part of the substrate.

In the embodiment of the plating apparatus that uses the plurality of elongate anodes 62 as described above, the direction and a magnitude of the electric field formed between the anode 62 and the substrate S1 are different depending on the shape, the number, and the arrangement of the used anodes 62. Therefore, the direction and the magnitude of the electric field formed between the anode 62 and the substrate S1 can be adjusted by the shape, the number, and the arrangement of the used anodes 62. Especially, arranging the end of the anode 62 having thin end to face the electric contact 17 of the substrate S1 can undergo reduced influence of the terminal effect. As described above, the current at the proximity of the electric contact of the substrate as the plating object is larger than that on the center portion of the substrate. Arranging the end of the anode 62 having the thin end to face the electric contact 17 of the substrate S1 decreases a projected area of the anode 62 on the substrate S1 near the end of the anode 62, that is, at the proximity of the electric contact 17 of the substrate S1, when the substrate S1 is viewed from the anode 62. Therefore, compared with a case that uses an anode having a constant width without thinly forming its end, the current flowing at the proximity of the electric contact 17 of the substrate S1 can be decreased, and as a result, the influence of the terminal effect can be canceled. In the above-described embodiment, the shape of the anode 62 can decrease the influence of the terminal effect. Thus, the distance between the anode and the substrate S1 can be made smaller than ever before. Making the distance between the anode and the substrate S1 small can make the plating tank small and can make the necessary amount of the plating solution smaller than ever before. In the above-described embodiment, the shape of the anode 62 can decrease the influence of the terminal effect. Thus, it is not necessary to arrange a regulating plate between the anode and the substrate as in a conventional method. However, the present invention does not eliminate the use of the regulating plate.

The above-described embodiment has describes the plating apparatus that uses the substrate holder 11 and the anode 62 to perform the plating process on the polygonal substrate S1. However, an anode having the same or like features is also applicable to a plating apparatus for performing the plating process on a circular substrate.

Figure 8:
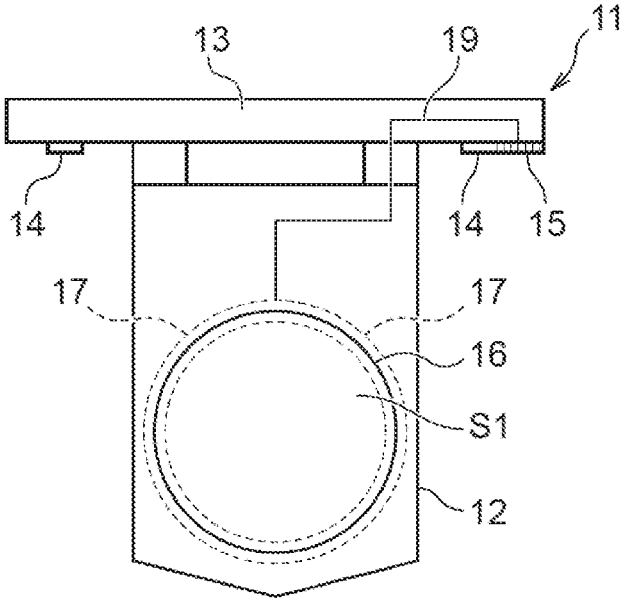
FIG. 8 is a schematic plan view of a substrate holder usable in the plating apparatus according to one embodiment.

FIG. 8 is a schematic plan view of a substrate holder 11 configured to be used for a plating apparatus (for example, the plating apparatus illustrated in FIGS. 1 and 2) according to one embodiment. The substrate holder 11 illustrated in FIG. 8 is configured to hold a circular substrate S1, unlike the substrate holder 11 illustrated in FIG. 3. The substrate holder 11 has an edge portion 16 forming a circular opening to expose the held circular substrate S1. The substrate holder 11 illustrated in FIG. 8 includes an electric contact 17 that contacts a surface of an outer peripheral portion of the circular substrate S1. The electric contact 17 is disposed on the substrate holder 11 illustrated in FIG. 8 such that the whole outer periphery of the circular substrate S1 contacts the electric contact 17. However, it may be configured such that only a part of the outer periphery of the circular substrate S1 contacts the electric contact 17. The substrate holder 11 illustrated in FIG. 8 can have a configuration similar to that described for the substrate holder 11 that holds the polygonal substrate S1 illustrated in FIG. 3 except that the substrate holder 11 illustrated in FIG. 8 holds the circular substrate S1 and the arrangement of the electric contact 17 is different corresponding to the circular substrate S1.

Figure 9:
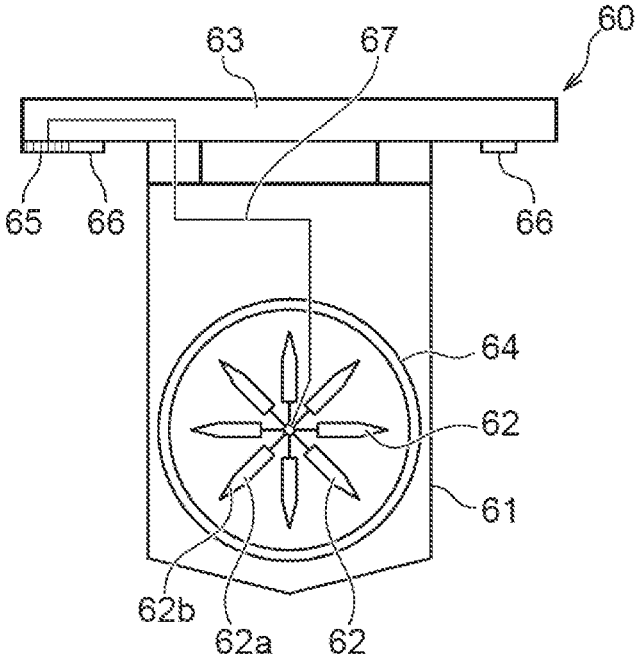
FIG. 9 is a schematic plan view illustrating an anode holder usable with the substrate holder illustrated in FIG. 8.

FIG. 9 is a schematic plan view illustrating an anode holder 60 configured to be used with the substrate holder 11 illustrated in FIG. 8. The anode holder 60 illustrated in FIG. 9 includes a tabular anode holder main body 61 and an arm portion 63 connected to the anode holder main body 61 similarly to the anode holder 60 illustrated in FIG. 4. The arm portion 63 includes a pair of pedestals 66. Installation of the pedestals 66 on the top surface of the peripheral wall of the plating tank 139 illustrated in FIG. 1 causes the anode holder 60 to be perpendicularly suspended and supported. The anode holder 60 in FIG. 9 includes a regulation plate 64 projecting from a surface of the tabular anode holder main body 61. The regulation plate 64, which is a dielectric (insulating) material having a thin wall shape, is formed into an annular shape in total. The annular regulation plate 64 has an inner area approximately identical to an area of the circular substrate S1 as the plating object. A plurality of anodes 62 are arranged in an inner region of the annular regulation plate 64.

In the embodiment illustrated in FIG. 9, the plurality of anodes 62 are elongate and arranged such that their longitudinal directions are oriented outside from near the center of the circular region surrounded by the annular regulation plate 64. In a state where the anode holder 60 and the substrate holder 11 are arranged on the plating tank 139, the longitudinal direction of the anode 62 is parallel to the surface of the substrate S1. The anode 62 illustrated in FIG. 9 includes a constant-width portion 62*a* having a constant width W and a tapered portion 62*b* where the width W decreases toward an end. In the anode 62 illustrated in FIG. 9, the tapered portion 62*b* is disposed on only one end portion of the constant-width portion 62*a*. In a state where the anode holder 60 in FIG. 9 and the substrate holder 11 in FIG. 8 are arranged on the plating tank 139, the end of the tapered portion 62*b* of the anode 62 is arranged to face the electric contact 17 of the substrate holder 11. As illustrated in FIG. 8, the electric contact 17 is arranged along the outer periphery of the circular substrate S1, and the anode 62 is arranged such that its longitudinal direction faces the outer periphery of the circular substrate S1. In other words, the electric contact 17 of the substrate holder 11 in FIG. 8 is perpendicular to the longitudinal direction of the anode 62 in FIG. 9. In the embodiment in the drawing, the anode 62 has a length L shorter than a radius of the circular substrate S1.

As illustrated in FIG. 9, the arm portion 63 includes a connector portion 65 configured to contact the electric contact disposed on the plating tank 139 when the pedestals 66 are installed on the top surface of the peripheral wall of the plating tank 139. As illustrated in FIG. 9, the connector portion 65 is connected to the respective anodes 62 with wiring 67. This electrically connects the anode holder 60 to the plating power supply 144 illustrated in FIG. 2 to apply the voltage and the current to the anode 62. As illustrated in FIG. 9, the respective anodes 62 are connected to the wiring 67 at end portions of the constant-width portions 62*a* of the anodes 62. In one embodiment, the respective anodes 62 are electrically arranged in parallel to ensure a configuration where identical electric potential is applied to the respective anodes 62 from the identical power supply 144. In one embodiment, it can be configured such that different electric potentials independent of one another are applied to all or a part of the plurality of anodes 62. In the anode holder 60 illustrated in FIG. 9, the other part may employ the features of the anode holder 60 and the anode 62 described with FIG. 4 to FIG. 7.

The substrate holder 11 and the anode 62 for performing the plating process on the circular substrate S1, which have been described with FIG. 8 and FIG. 9, also provide an effect similar to that of the substrate holder 11 and the anode 62 for performing the plating process on the polygonal substrate S1.

Figure 10:
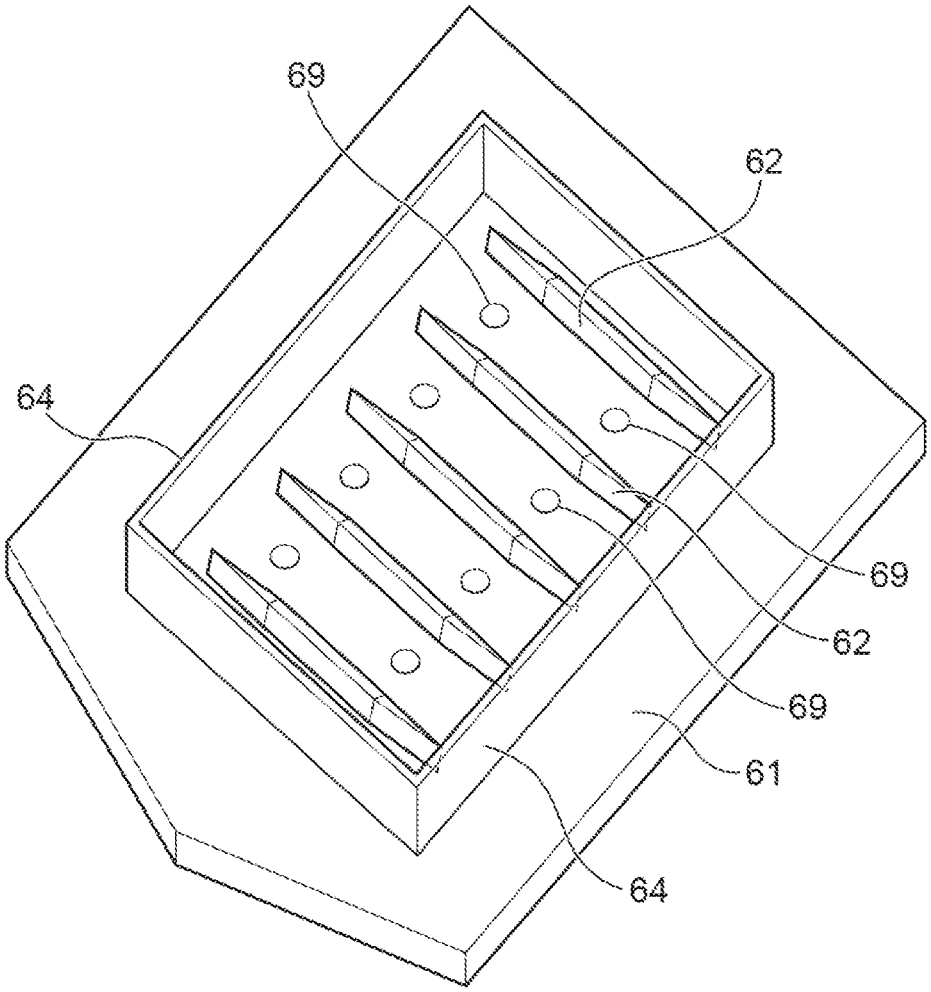
FIG. 10 is a schematic perspective view of an anode holder according to one embodiment.

FIG. 10 is a schematic perspective view of an anode holder 60 according to one embodiment. However, similarly to FIG. 5, FIG. 10 illustrates only the anode holder main body 61, the anode 62, and the regulation plate 64 of the anode holder 60 for clarity of illustration and omits the arm portion 63 and the like. In the anode holder 60 illustrated in FIG. 10, a plurality of elongate anodes 62 are arranged in parallel on the anode holder main body 61 as illustrated in the drawing. In the embodiment in the drawing, the plurality of anodes 62 are equally spaced. The number of anodes 62 is optional. In the anode holder 60 illustrated in FIG. 10, nozzles 69 are arranged in regions between the anodes 62 arranged in parallel as illustrated in the drawing. The nozzle 69 is configured to be connected to a supply source of the plating solution to discharge the plating solution into the plating tank 139. For example, the nozzle 69 may be configured to discharge the plating solution that exists in the overflow tank 138 illustrated in FIG. 2 or may be configured to supply new plating solution. The anode holder 60 illustrated in FIG. 10 may have a feature similar to that of the anode holder 60 described with FIG. 5 except that the nozzles 69 are provided or may have a different given feature.

The anode holder 60 according to the embodiment illustrated in FIG. 10 includes the nozzle 69 that discharges the plating solution. Thus, discharging the plating solution from the nozzle 69 during the plating process can stir the plating solution in the plating tank 139. In one embodiment, the use of the anode holder 60 illustrated in FIG. 10 can omit the paddle 145 that stirs the plating solution Q illustrated in FIG. 2. As described above, in the plating apparatus including the anode 62 disclosed in this description, the distance between the anode and the substrate can be decreased. Omitting the paddle 145 can further decrease the distance between the anode and the substrate. However, both of the anode holder 60 illustrated in FIG. 10 and the paddle 145 illustrated in FIG. 2 may be used. FIG. 10 illustrates the anode holder that holds the anode used when the polygonal substrate is plated. However, the nozzle may be provided on the anode holder that holds the anode for plating the circular substrate. For example, in the anode holder 60 illustrated in FIG. 9, the nozzles 69 that discharge the plating solution can be provided on spaces between the arranged plurality of anodes 62 or given positions.

From the above-described embodiments, at least the following technical ideas are obtained.

Configuration 1

According to a configuration 1, a plating apparatus is provided. The plating apparatus includes a substrate holder for holding a substrate as a plating object, an electric contact disposed on the substrate holder to apply a current to a substrate, and a plurality of anodes arranged to face the substrate holder. Each of the plurality of anodes has a long and thin shape. Each of the plurality of anodes is arranged such that a longitudinal direction of the anode is parallel to a surface of the substrate held onto the substrate holder and such that at least one end in the longitudinal direction of each of the anodes faces the electric contact of the substrate holder.

Configuration 2

According to a configuration 2, in the plating apparatus according to the configuration 1, each of the plurality of anodes has an end in the longitudinal direction, and the anode is formed thinner near the end compared with another part of the anode.

Configuration 3

According to a configuration 3, in the plating apparatus according to the configuration 2, each of the plurality of anodes includes a tapered portion whose width decreases toward the end and a constant-width portion having a constant width, and the tapered portion is configured attachable to and removable from the constant-width portion.

Configuration 4

According to a configuration 4, in the plating apparatus according to any one configuration of the configuration 1 to the configuration 3, each of the plurality of anodes has an approximately rectangular cross-section when each of the plurality of anodes is cut out in a planar surface perpendicular to the longitudinal direction.

Configuration 5

According to a configuration 5, in the plating apparatus according to any one configuration of the configuration 1 to the configuration 4, the substrate holder is configured to hold a quadrangular substrate, and the electric contact is configured to contact opposed two sides of a quadrangular substrate. The plurality of anodes are arranged such that the longitudinal direction of the anode is perpendicular to the two sides that contact the electric contact, when a substrate is viewed from a side of the anode.

Configuration 6

According to a configuration 6, in the plating apparatus according to any one configuration of the configuration 1 to the configuration 4, the substrate holder is configured to hold a circular substrate, and the electric contact is configured to contact an outer peripheral portion of a circular substrate. The plurality of anodes are arranged such that the end in the longitudinal direction of the anode faces the outer peripheral portion that contacts the electric contact, when a substrate is viewed from a side of the anode.

Configuration 7

According to a configuration 7, in the plating apparatus according to any one configuration of the configuration 1 to the configuration 6, in each of the plurality of anodes, when a dimension parallel to a direction perpendicular to a surface of a substrate is defined as a height H and a dimension in a direction perpendicular to the longitudinal direction and a height direction is defined as a width W, the anode includes a tapered portion where the width W decreases toward the end and a constant-width portion having a constant width W2, the tapered portion and the constant-width portion have an identical height H, and when a width of the end of the tapered portion is defined as W1, a condition of $W1<W2<H$ is satisfied.

Configuration 8

According to a configuration 8, in the plating apparatus according to any one configuration of the configuration 1 to the configuration 6, in each of the plurality of anodes, when a dimension parallel to a direction perpendicular to a surface of a substrate is defined as a height H and a dimension in a direction perpendicular to the longitudinal direction and a height direction is defined as a width W, the anode includes a tapered portion where the width W decreases toward the end and a constant-width portion having a constant width W2, the tapered portion and the constant-width portion have an identical height H, and when a width of the end of the tapered portion is defined as W1, a condition of $2\times W1<W2\leq 10\times W1$ and $10\times W1<H\leq 30\times W1$ is satisfied.

Configuration 9

According to a configuration 9, in the plating apparatus according to any one configuration of the configuration 1 to the configuration 8, each of the plurality of anodes is an insoluble anode and contains an alloy containing titanium and platinum or an alloy containing titanium and iridium oxide.

Configuration 10

According to a configuration 10, in the plating apparatus according to any one configuration of the configuration 1 to the configuration 9, the plating apparatus includes an anode holder configured to hold the plurality of anodes. The anode holder includes a nozzle for spouting a plating solution.

REFERENCE SIGNS LIST

11 . . . substrate holder
13 . . . arm portion
14 . . . pedestal
15 . . . connector portion
17 . . . electric contact
60 . . . anode holder
61 . . . anode holder main body
62 . . . anode
62*a* . . . constant-width portion
62*b* . . . tapered portion
63 . . . arm portion
64 . . . regulation plate
65 . . . connector portion
66 . . . pedestal
69 . . . nozzle
100 . . . plating apparatus
138 . . . overflow tank
139 . . . plating tank
144 . . . power supply
145 . . . paddle
S1 . . . substrate
Q . . . plating solution

What is claimed is:

1. A plating apparatus comprising:

a substrate holder for holding a substrate as a plating object;

an electric contact disposed on the substrate holder to apply a current to a substrate; and a plurality of anodes arranged to face the substrate holder, wherein each of the plurality of anodes has a straight long and thin shape with a length longer than a width, and each of the plurality of anodes is arranged such that a longitudinal direction of the anode is parallel to a surface of the substrate held onto the substrate holder, wherein the substrate holder is configured to hold a quadrangular substrate, and the electric contact is configured to contact opposed two sides of a quadrangular substrate, and the plurality of anodes are arranged such that the longitudinal direction of the anode is perpendicular to the two sides that contact the electric contact, when a substrate is viewed from a side of the anode.

2. The plating apparatus according to claim 1, wherein each of the plurality of anodes has an end in the longitudinal direction, and the anode is formed thinner near the end compared with another part of the anode.

3. The plating apparatus according to claim 2, wherein each of the plurality of anodes includes a tapered portion whose width decreases toward the end and a constant-width portion having a constant width, and the tapered portion is configured attachable to and removable from the constant-width portion.

4. The plating apparatus according to claim 1, wherein each of the plurality of anodes has an approximately rectangular cross-section when each of the plurality of anodes is cut out in a planar surface perpendicular to the longitudinal direction.

5. The plating apparatus according to claim 1, wherein in each of the plurality of anodes, when a dimension parallel to a direction perpendicular to a surface of a substrate is defined as a height H and a dimension in a direction perpendicular to the longitudinal direction and a height direction is defined as a width W, the anode includes a tapered portion where the width W decreases toward the end and a constant-width portion having a constant width W2, the tapered portion and the constant-width portion have an identical height H, and when a width of the end of the tapered portion is defined as W1, a condition of $W1<W2<H$ is satisfied.

6. The plating apparatus according to claim 1, wherein in each of the plurality of anodes, when a dimension parallel to a direction perpendicular to a surface of a substrate is defined as a height H and a dimension in a direction perpendicular to the longitudinal direction and a height direction is defined as a width W, the anode includes a tapered portion where the width W decreases toward the end and a constant-width portion having a constant width W2, the tapered portion and the constant-width portion have an identical height H, and when a width of the end of the tapered portion is defined as W1, a condition of $2\times W1<W2\leq 10\times W1$ and $10\times W1<H\leq 30\times W1$ is satisfied.

7. The plating apparatus according to claim 1, wherein each of the plurality of anodes is an insoluble anode and contains an alloy containing titanium and platinum or an alloy containing titanium and iridium oxide.

8. The plating apparatus according to claim 1 comprising an anode holder configured to hold the plurality of anodes, wherein the anode holder includes a nozzle for spouting a plating solution.

* * * * *